US007075244B2

(12) United States Patent
Kang et al.

(10) Patent No.: US 7,075,244 B2
(45) Date of Patent: Jul. 11, 2006

(54) MULTI-LAMP BACKLIGHT SYSTEM

(75) Inventors: Chang-Lung Kang, Tucheng (TW); Ching-Fu Hsueh, Bade (TW); Yu-Feng Wei, Taoyuan (TW); Wan-Chin Hsu, Taoyuan (TW); Cheng-Hsien Chien, Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 27 days.

(21) Appl. No.: 10/644,290

(22) Filed: Aug. 19, 2003

(65) Prior Publication Data

US 2004/0066151 A1 Apr. 8, 2004

(30) Foreign Application Priority Data

Oct. 2, 2002 (TW) ..... 91122715 A

(51) Int. Cl.
*H05B 37/02* (2006.01)
*H05B 41/16* (2006.01)

(52) U.S. Cl. ..... 315/212; 315/246; 315/254; 315/276

(58) Field of Classification Search ..... 315/219, 315/224–225, 244, 246, 276, 282, 212, 254; 336/221–225
See application file for complete search history.

(56) References Cited

U.S. PATENT DOCUMENTS

| | | | | |
|---|---|---|---|---|
| 4,547,705 | A * | 10/1985 | Hirayama et al. | 315/277 |
| 5,144,203 | A * | 9/1992 | Fujita et al. | 315/169.3 |
| 6,104,146 | A * | 8/2000 | Chou et al. | 315/277 |
| 6,150,772 | A * | 11/2000 | Crane | 315/291 |
| 6,310,444 | B1 * | 10/2001 | Chang | 315/282 |
| 6,515,427 | B1 * | 2/2003 | Oura et al. | 315/141 |
| 6,717,372 | B1 * | 4/2004 | Lin et al. | 315/282 |

FOREIGN PATENT DOCUMENTS

TW 570268 1/2004

* cited by examiner

*Primary Examiner*—Thuy Vinh Tran
(74) *Attorney, Agent, or Firm*—Ladas & Parry LLP

(57) ABSTRACT

A multi-lamp backlight system. The system includes a core, a first coil set wrapped around the core, to which a first AC voltage is applied, a second and third coil sets wrapped around the core and respectively disposed on two sides of the first coil set, on which a second and third AC voltage are induced by the first voltage signal applied to the first coil set respectively, wherein the numbers of coils of the second and third coil sets are substantially the same, and first and second lamps are supplied with power by the second and third AC voltages respectively.

2 Claims, 5 Drawing Sheets

MULTI-LAMP BACKLIGHT SYSTEM

BACKGROUND OF THE INVENTION

1. Field of the Invention

The present invention relates to a backlight system and particularly to a multi-lamp backlight system with only a single transformer, with driving currents of the lamps inherently balanced.

2. Description of the Prior Art

Present displays, such as LCD, require a backlight system of small size and high power efficiency. Thus, CCFL (Cold Cathode Fluorescent Lamp) is popularly used in the backlight system. Moreover, backlight systems with only a single lamp are not suitable for large size displays requiring much higher illumination. Only multi-lamp backlight systems have illumination performance to satisfy this requirement.

FIG. 1 is a diagram showing a conventional multi-lamp backlight system. It includes a driving circuit 11, a transformer composed of a primary coil set 121, a secondary coil set 122 and a core 123, capacitors C1 and C2, current balancing circuits 13, and lamps 151 and 152. The driving circuit 11 provides a low AC voltage applied to the primary coil set 121 of the transformer 12 so that a high AC voltage is induced on the secondary coil set 122, by which the lamps 151 and 152 are supplied with power. Since the resistances or parasitic capacitances of lines connecting the transformer 12 to the lamps 151 and 152 can be different, the magnitudes of thus generated driving currents of the lamps 151 and 152 can also differ. This results in illumination difference between the lamps 151 and 152, which degrades the performance of the display. The current balancing circuits 13 eliminate the current difference of the lamps 151 and 152.

FIG. 2 is a diagram showing another conventional multi-lamp backlight system. For sake of clarity, the same elements in FIGS. 1 and 2 refer to the same symbols. The systems shown in FIGS. 1 and 2 are similar, except that the current balancing circuits 23 in FIG. 2 are coupled between the lamps 151 and 152, and ground.

FIG. 3 is a diagram showing the structure of the transformer 12 used in conventional multi-lamp backlight systems. The primary and secondary coil set 121 and 122 are both wrapped around and respectively disposed on two sides of the core 123.

With the conventional transformer structure, the lamps in the backlight system must be connected in series or parallel when using one single transformer, or connected to one transformer each when using multiple transformers since there is only one secondary coil set. However, the transformer suffers much high voltage on its secondary coil set with the lamps serially connected, additional current balancing circuits are needed when the lamps are connected in parallel, and a backlight system with multiple transformers has a high cost and occupies a large space in the display.

SUMMARY OF THE INVENTION

The object of the present invention is to provide a multi-lamp backlight system with only a single transformer, with driving currents of the lamps inherently balanced.

The present invention provides a multi-lamp backlight system comprising a core, a first coil set wrapped around the core, to which a first AC voltage is applied, a second and third coil sets wrapped around the core and respectively disposed on two sides of the first coil set, in which a second and third AC voltage are induced by the first voltage signal applied to the first coil set respectively, wherein the numbers of coils of the second and third coil sets are substantially the same, and a first and second lamp supplied with power by the second and third AC voltage respectively.

The present invention further provides a multi-lamp backlight system comprising a core, a first coil set wrapped around the core, to which a first AC voltage is applied, a plurality of second coil sets wrapped around the core and symmetrically disposed on two sides of the first coil set, on each of which a second AC voltage is induced by the first voltage signal applied to the first coil set, wherein the numbers of coils of the second coil sets are substantially the same, and a plurality of lamps are supplied with power by the second AC voltages.

The present invention also provides a transformer for multi-lamp backlight system, the system comprising a core, a first coil set wrapped around the core, and a second and third coil sets wrapped around the core and respectively disposed on two sides of the first coil set, wherein the numbers of coils of the second and third coil sets are substantially the same.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 1:
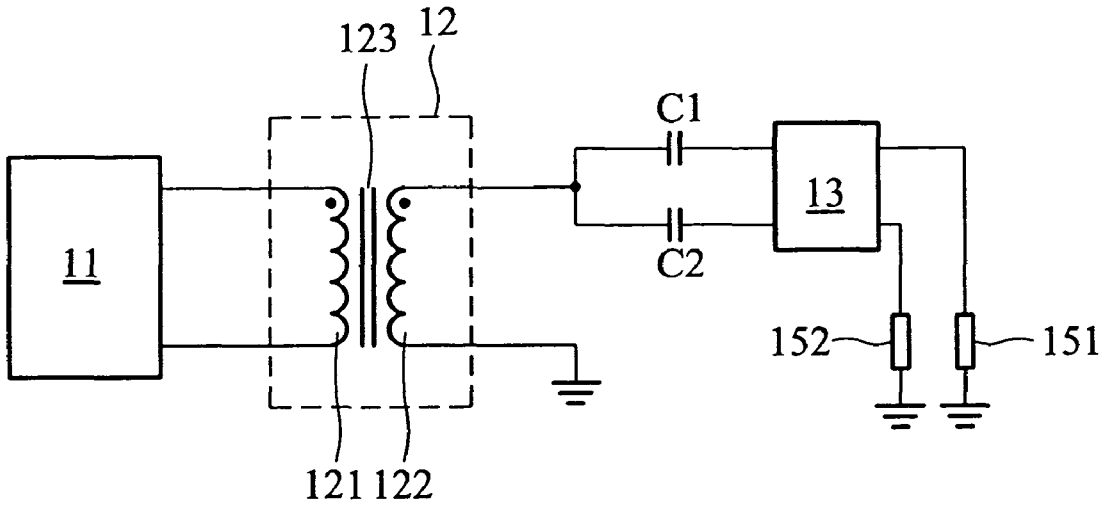
FIG. 1 (PRIOR ART)
FIG. 1 is a diagram showing a conventional multi-lamp backlight system.
Figure 2:
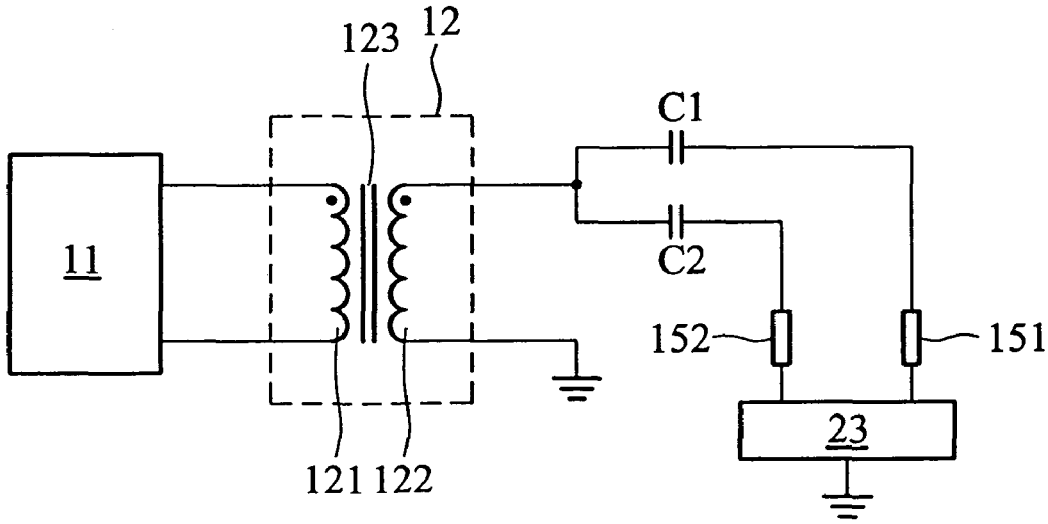
FIG. 2 (PRIOR ART)
FIG. 2 is a diagram showing another conventional multi-lamp backlight system.
Figure 3:
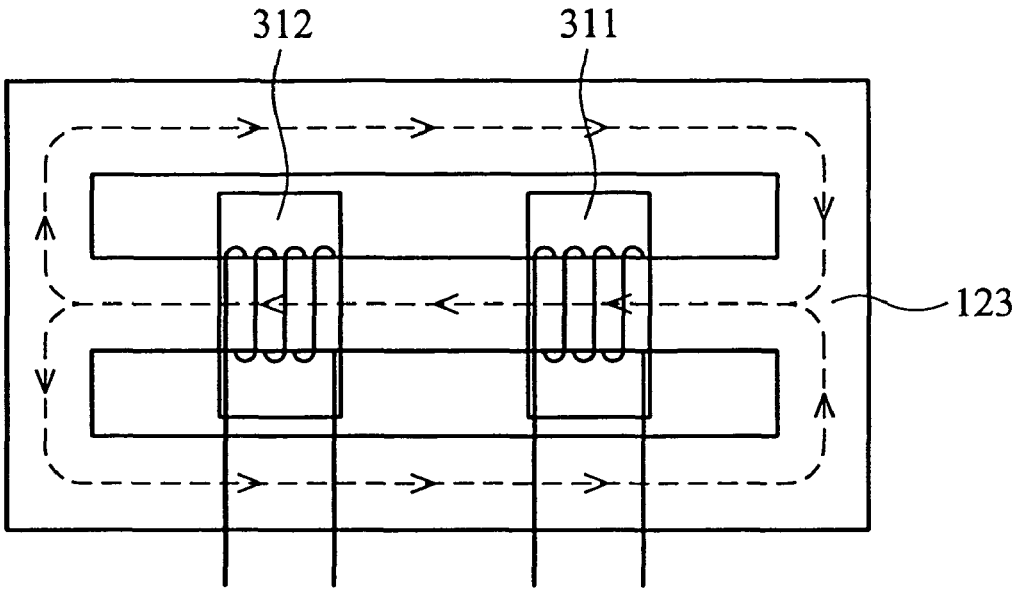
FIG. 3 (PRIOR ART)
FIG. 3 is a diagram showing the structure of the transformer used in conventional multi-lamp backlight systems.
Figure 4:
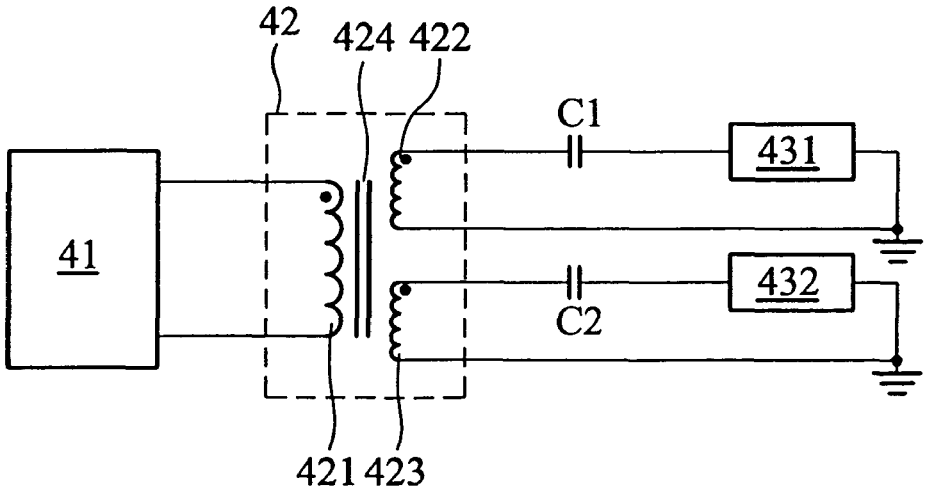
FIG. 4 is a diagram showing a multi-lamp backlight system according to a first embodiment of the invention.

FIG. 4 is a diagram showing a multi-lamp backlight system according to a first embodiment of the invention. It includes a driving circuit 41, a transformer 42 composed of a primary coil set 421, secondary coil sets 422 and 423, and a core 424, capacitor Cl and C2, and discharge lamps 431 and 432. The primary coil set 421 is wrapped around the core 424 with a low AC voltage from the driving circuit 41 applied thereto. The secondary coil sets 422 and 423 are also wrapped around the core 424, on each of which a high AC voltage is induced by the low AC voltage on the primary coil set 421. The lamps 431 and 432 are supplied with power by the high AC voltage on the secondary coil sets 422 and 423 respectively. The discharge lamps 431 and 432 may be CCFLs. Each of the secondary coil sets 422 and 423 has two ends of, respectively, first and second polarities. The lamps 431 and 432 are coupled to the ends of the first polarity of the secondary coil sets 422 and 423 respectively. The numbers of coils of the secondary coil sets 422 and 423 are substantially the same.

Figure 5:
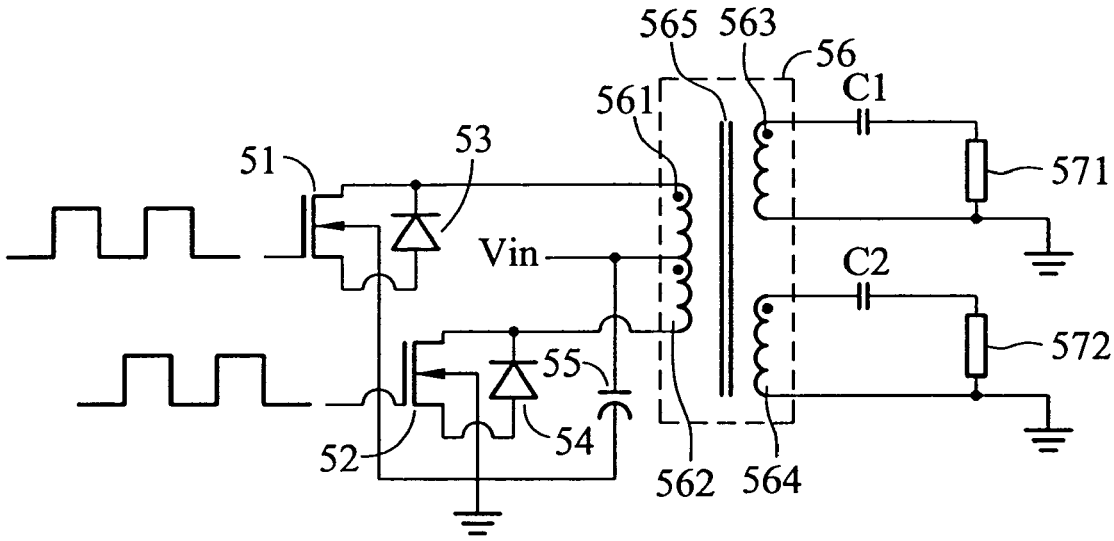
FIG. 5 is a diagram showing a multi-lamp backlight system according to a second embodiment of the invention.

FIG. 5 is a diagram showing a multi-lamp backlight system according to a second embodiment of the invention. It includes transistors 51 and 52, diodes 53 and 54, capacitors 55, C1 and C2, a transformer 56 composed of primary coil sets 561 and 562, secondary coil sets 563 and 564, and a core 565, and discharge lamps 571 and 572. The primary coil set 561 is wrapped around the core 565 and has one end coupled to receive an AC voltage Vin. The other primary coil set 562 is wrapped around the core 565 and has one end coupled to receive the AC voltage Vin. The transistor 51 has a drain coupled to one end of the primary coil set 561, and a gate coupled to receive a square wave signal. The transistor 52 has a drain coupled to one end of the primary coil set 562, a gate coupled to receive another square wave signal and a bulk coupled to ground. The diodes 53 and 54 are respectively coupled between the source and drain of the transistor 51, and the source and drain of the transistor 52. The capacitor 55 is coupled between one end of the primary coil set 561 and the bulk of the transistor 51. The secondary coil sets 563 and 564 are wrapped around the core 565, on which high AC voltages are induced by the low AC voltages applied to the primary coil sets 561 and 562. The lamps 571 and 572 are supplied with power by the high voltages on the secondary coil sets 563 and 564. The capacitors C1 and C2 are respectively coupled between the lamp 571 and the secondary coil set 563, and the lamp 572 and the secondary coil set 564. The discharge lamps 571 and 572 may be CCFLs. Each of the secondary coil sets 563 and 564 has two ends of, respectively, first and second polarities. The capacitors C1 and C2 are coupled to the ends of the first polarity of the secondary coil sets 563 and 564 respectively. The numbers of coils of the secondary coil sets 563 and 564 are substantially the same.

Figure 6:
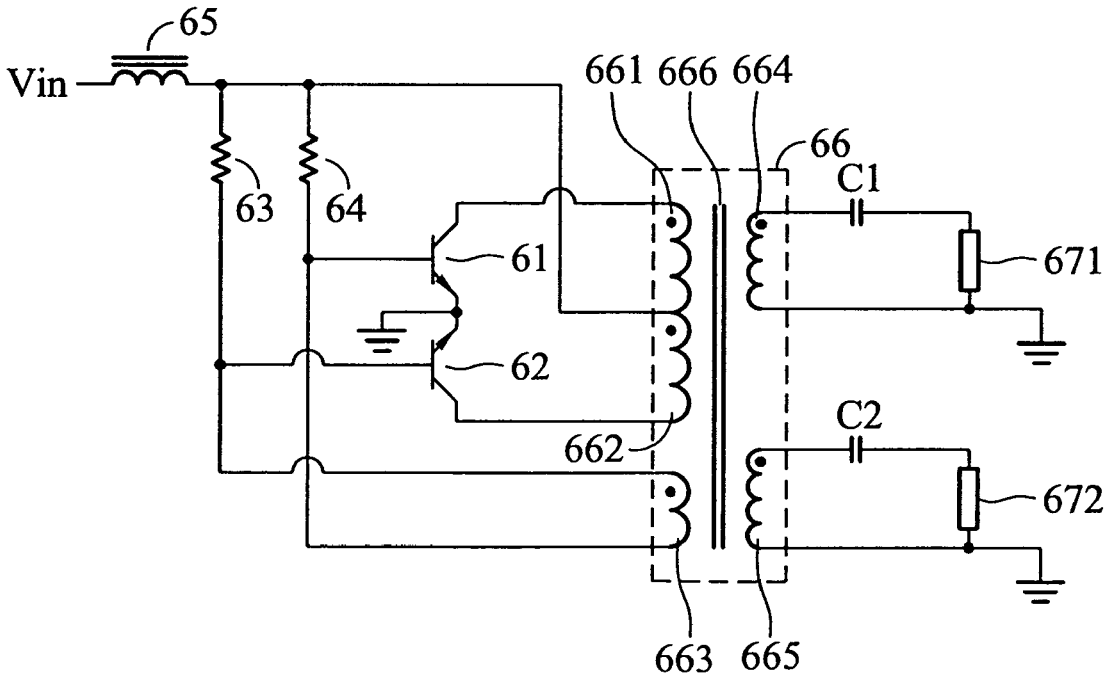
FIG. 6 is a diagram showing a multi-lamp backlight system according to a third embodiment of the invention.

FIG. 6 is a diagram showing a multi-lamp backlight system according to a third embodiment of the invention. It includes transistors 61 and 62, resistors 63 and 64, an inductor 65, capacitors C1 and C2, a transformer 66 composed of primary coil sets 661, 662 and 663, secondary coil sets 664 and 665, and a core 666, and discharge lamps 671 and 672. The primary coil sets 661, 662 and 663 are wrapped around the core 666. One end of the primary coil set 661 is coupled to one end of the primary coil set 662. The inductor 65 has one end coupled to receive an AC voltage Vin and the other end to the primary coil set 661. The transistor 61 has a drain coupled to one end of the primary coil set 661, a source coupled to ground and a gate coupled to one end of the primary coil set 663. The transistor 62 has a drain coupled to one end of the primary coil set 662, a source coupled to ground and a gate coupled to one end of the primary coil set 663. The resistors 63 and 64 are respectively coupled between the gate of the transistor 62 and one end of the primary coil set 661, and the gate of the transistor 61 and one end of the primary coil set 661. The secondary coil sets 664 and 665 are wrapped around the core 666, on which high AC voltages are induced by the low AC voltages applied to the primary coil sets 661, 662 and 663. The lamps 671 and 672 are supplied with power by the high voltages on the secondary coil sets 664 and 665. The capacitors C1 and C2 are respectively coupled between the lamp 671 and the secondary coil set 664, and the lamp 672 and the secondary coil set 664. The discharge lamps 671 and 672 may be CCFLs. Each of the secondary coil sets 664 and 665 has two ends of, respectively, first and second polarities. The capacitors C1 and C2 are coupled to the ends of the first polarity of the secondary coil sets 664 and 665 respectively. The numbers of coils of the secondary coil sets 664 and 665 are substantially the same.

Figure 7:
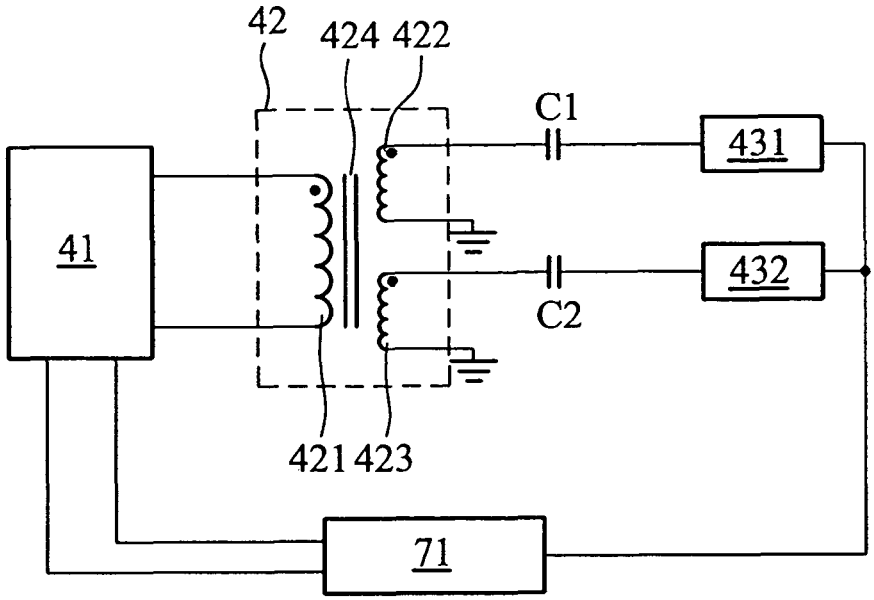
FIG. 7 is a diagram showing a multi-lamp backlight system according to a fourth embodiment of the invention.

FIG. 7 is a diagram showing a multi-lamp backlight system according to a fourth embodiment of the invention. For sake of clarity, the same elements shown in FIGS. 4 and 7 refer to the same symbols. The systems shown in FIGS. 4 and 7 are similar, except that the system in FIG. 7 has an additional feedback network 71 to further stabilize the driving currents of the lamps 431 and 432 by feeding back the AC voltages to the driving circuit 41.

Figure 8:
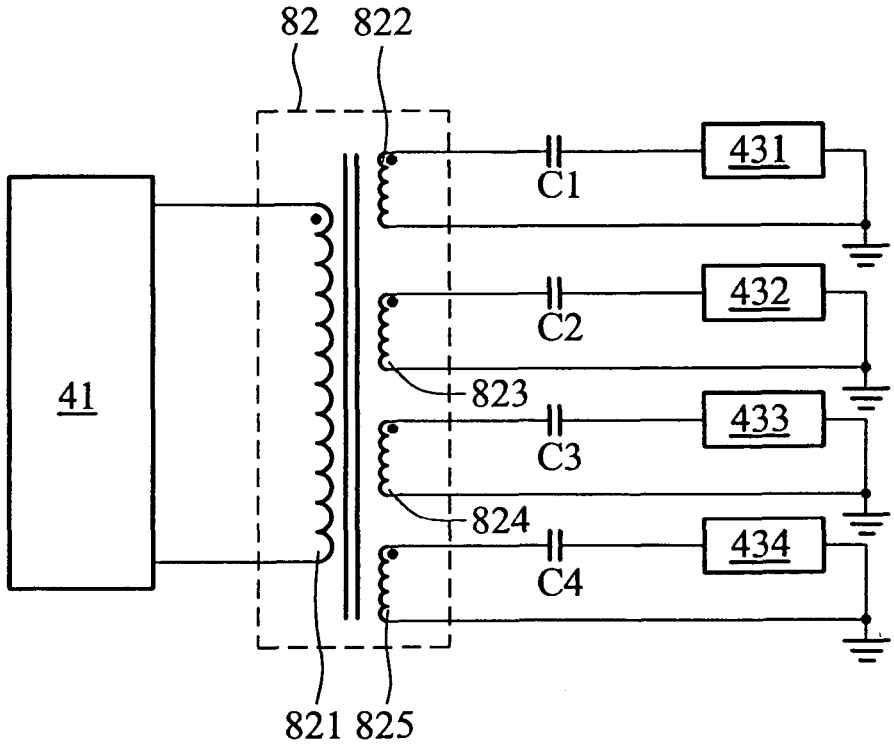
FIG. 8 is a diagram showing a multi-lamp backlight system according to a fifth embodiment of the invention.

FIG. 8 is a diagram showing a multi-lamp backlight system according to a fifth embodiment of the invention. For sake of clarity, the same elements shown in FIGS. 4 and 8 refer to the same symbols. The systems shown in FIGS. 4 and 8 are similar, except that the system in FIG. 8 has four secondary coil sets 822~825 respectively to drive four lamps 431~434. Each of the secondary coil sets 822~825 has two ends of, respectively, first and second polarities. The lamps 431~434 are coupled to the ends of the first polarity of the secondary coil sets 822~825 respectively. The numbers of coils of the secondary coil sets 822~825 are substantially the same.

Figure 9:
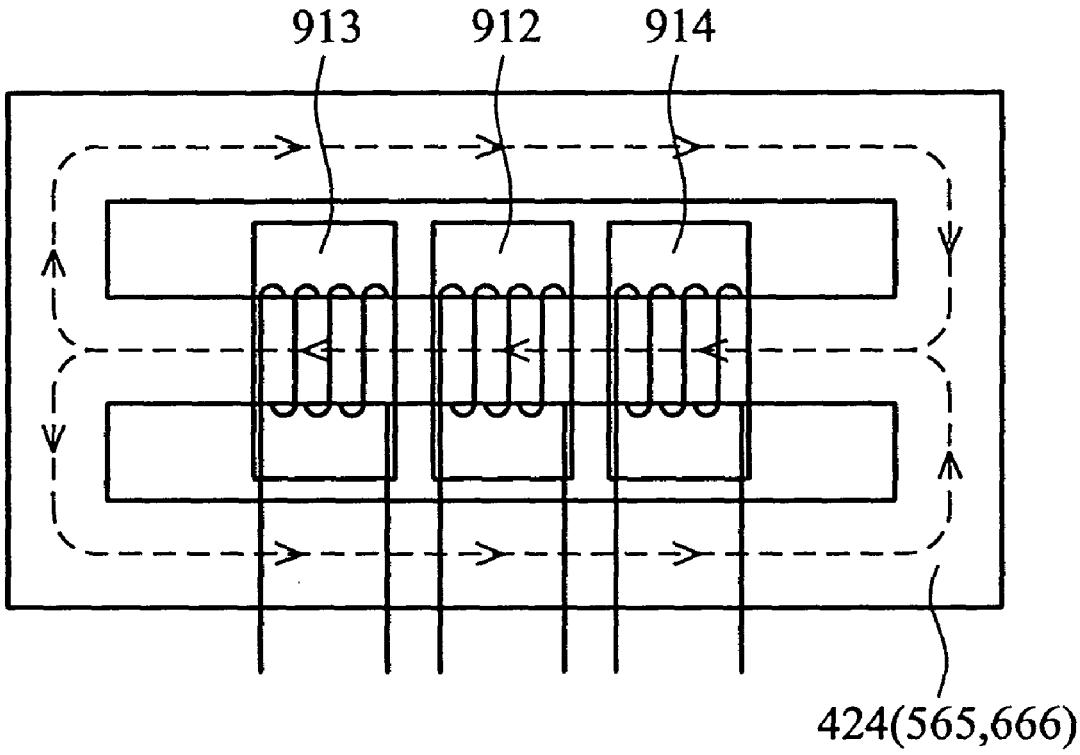
FIG. 9 is a diagram showing the structure of the transformers used in the backlight system shown in FIG. 4~8.

FIG. 9 is a diagram showing the structure of the transformers used in the backlight system shown in FIG. 4~8. All the primary coil sets are wrapped around and disposed on the center portion 912 of the core 424 (565, 666) while all the secondary coil sets are wrapped around and disposed on the lateral portions 913 and 914 so that the primary coil sets are disposed between the secondary coil sets.

The present invention has the advantages of multiple lamps driven by only a single transformer, saving space and cost, inherently balanced currents with no need for any current balancing circuit, and a current flow through two secondary coil sets, which increases the endurance of the transformer.

In conclusion, the present invention provides a multi-lamp backlight system using only a single transformer with multiple secondary coil sets to drive multiple lamps. The driving currents are inherently balanced since the numbers of the coils of the secondary coil sets are substantially the same. There is neither need for an additional current balancing circuit nor for multiple transformers in the multi-lamp backlight system.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A multi-lamp backlight system comprising:

a core;

a first coil set wrapped around the core, to which a first AC voltage is applied;

a second coil set and a third coil set wrapped around the core and respectively disposed on first and second sides of the first coil set, on which second and third AC voltages are induced by the first AC voltage signal applied to the first coil set respectively, wherein the number of coils in the second and third coil sets are substantially the same;

a first lamp and a second lamp supplied with power by the second and third AC voltages respectively;

a first driving circuit providing the first AC voltage; and a plurality of fourth coil sets and a plurality of third lamps, wherein numbers of coils of the fourth coil sets are substantially the same, the fourth coil sets are symmetrically disposed on first and second sides of the first coil set, the first AC voltage applied to the first coil set induces a fourth AC voltage on each of the fourth coil sets and the third lamps are supplied with power by the fourth AC voltages.

2. A multi-lamp backlight system comprising:

a core;

a first coil set wrapped around the core, to which a first AC voltage is applied;

a second coil set and a third coil set wrapped around the core and respectively disposed on first and second sides of the first coil set, on which second and third AC voltages are induced by the first AC voltage signal applied to the first coil set respectively, wherein the number of coils in the second and third coil sets are substantially the same;

a first lamp and a second lamp supplied with power by the second and third AC voltages respectively;

a first driving circuit providing the first AC voltage;

a fourth coil set wrapped around the core, and having a first end coupled to a first end of the first coil; and a plurality of fifth coil sets and a plurality of fourth lamps, wherein number of coils of the fifth coil sets are substantially the same, the fifth coil sets are symmetrically disposed on first and second sides of the first and fourth coil sets so that the first and fourth coil sets are disposed between the fifth coil sets, the first AC voltage applied to the first coil set induces a seventh AC voltage on each of the fifth coil sets, and the fourth lamps are supplied with power by the seventh AC voltages.

* * * * *